United States Patent [19]

Hall

[11] 3,956,997

[45] May 18, 1976

[54] DRIVE-UP TELLER WINDOW PROTECTION APPARATUS

[76] Inventor: B. Mike Hall, 2408 Geraldine, Oklahoma City, Okla. 73107

[22] Filed: Jan. 9, 1975

[21] Appl. No.: 539,726

[52] U.S. Cl. ..... 109/20
[51] Int. Cl.[2] ..... E05G 5/00
[58] Field of Search ..... 109/2, 10, 20, 21, 19, 109/21.5

[56] References Cited

UNITED STATES PATENTS

| | | | |
|---|---|---|---|
| 2,011,120 | 8/1935 | Searle | 109/20 X |
| 3,230,912 | 1/1966 | Hohmann | 109/20 |

*Primary Examiner*—Paul R. Gilliam
*Assistant Examiner*—David H. Corbin
*Attorney, Agent, or Firm*—Laney, Dougherty, Hessin & Fish

[57] ABSTRACT

A drive-up teller window protection apparatus which includes a plurality of downwardly directed nozzles connected to a fluid distribution system supported and housed in a roof structure extending outwardly from a drive-up teller window and positioned a distance above the ground sufficient to allow automobiles to pass thereunder. The fluid distribution system is connected to a fluid reservoir via a conduit having a pressure relief valve and a one-way check valve interposed therein. A source of pressurized fluid communicates with the fluid reservoir via a conduit having a remotely operated valve, a two-way valve, a one-way check valve and a pressure relief valve interposed therein. A second conduit communicates between the two-way valve and the fluid distribution system and includes a one-way check valve interposed therein. An electrical control circuit is disclosed which is connected to a source of electrical potential and includes at least one operating switch between the source of electrical potential and the remotely controlled and operated valve to provide actuation thereof. The fluid reservoir contains a quantity of viscous, adhesive and substantially opaque liquid chemical agent which may be forced from the fluid reservoir by the application of fluid pressure to the fluid reservoir whereby the liquid chemical agent is sprayed from the downwardly directed nozzles onto the front and rear windshields and side windows of a holdup vehicle upon actuation of the remotely controlled valve. The apparatus further includes means for periodically testing the operation of the apparatus and for purging the fluid distribution system and nozzles of liquid chemical agent after operation of the apparatus.

12 Claims, 2 Drawing Figures

DRIVE-UP TELLER WINDOW PROTECTION APPARATUS

BACKGROUND OF THE INVENTION

1. Field of the Invention

This invention relates generally to improvements in bank constructions and more particularly, but not by way of limitation, to drive-up teller window constructions incorporating security devices.

2. Description of the Prior Art

The prior art contains a number of teachings of apparatus for protecting conventional walk-up teller windows within a bank or similar institution. Various schemes are disclosed for directing immobilizing gases or identifying dyes on an individual attempting to holdup a teller in a walk-up teller's window or booth.

With the advent of the drive-in or drive-up teller window used by banks or similar institutions for the convenience of the motoring public, it has been found that there is a need for an apparatus for providing improved security protection from the possibility of an attempted holdup of a manned drive-up teller window from a vehicle. The known prior art teachings are not capable of providing such needed protection of drive-up teller windows.

SUMMARY OF THE INVENTION

The present invention contemplates a drive-up teller window protection apparatus in a form of protective construction for use with a drive-up window in a wall with outer and inner sides, having a teller's counter spaced inwardly of the inner side of the wall. The apparatus includes a plurality of downwardly directed nozzles supported outwardly from the outer side of the wall and positioned above the drive-up window, a fluid distribution system communicating with the nozzles, and a fluid reservoir communicating with the fluid distribution system. A quantity of liquid chemical agent is disposed within the fluid reservoir, with the liquid being relatively viscous, adhesive and substantially opaque. A source of pressurized fluid communicates with the fluid reservoir through a conduit having valve means disposed therein intermediate the source of pressurized fluid and the fluid reservoir for alternately opening and closing the conduit to fluid flow from the source of pressurized fluid to the fluid reservoir. The apparatus further includes valve control means operatively connected to the valve means for opening and closing the valve means in response to actuation of the valve control means from a position remote from the valve means.

An object of the invention is to increase the security of banking institutions or the like.

Another object of the invention is to provide a protective construction for use with a drive-up window in a banking institution or the like which provides means for immobilizing the vehicle of an individual attempting to hold up such a drive-up window.

A further object of the invention is to provide a drive-up teller window protection apparatus which is reliable and economical in construction and operation.

Other objects and advantages of the present invention will be evident from the following detailed description when read in conjunction with the accompanying drawing.

DESCRIPTION OF THE PREFERRED EMBODIMENT

Figure 1:
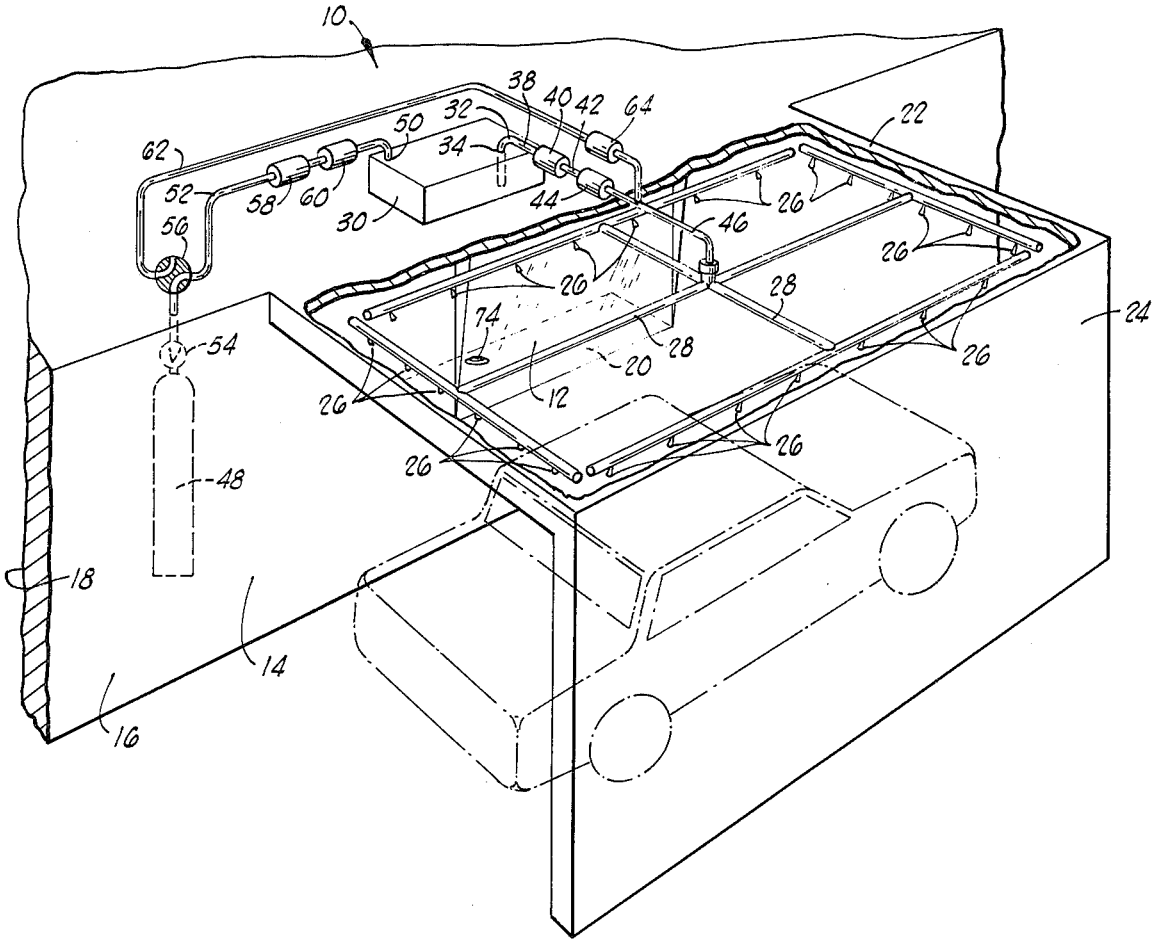
FIG. 1 is a partially diagrammatical perspective view illustrating the present invention installed in conjunction with a drive-up teller window.

Referring now to the drawings, the drive-up teller window protection apparatus of the present invention is generally designated by the reference character 10. The apparatus 10 is employed in conjunction with a drive-up window 12 installed in a wall 14 of a building. The wall 14 has an outer side 16 and an inner side 18. A teller's counter 20 is spaced inwardly of the inner side 18 of the wall 14 thus providing the conventional structure of a manned drive-up teller window as typically used in drive-in banking institutions or the like.

A horizontally extending roof structure 22 extends outwardly from the outer side 16 of the wall 14 and is preferably supported by a vertically extending wall structure 24 spaced outwardly from and substantially parallel to the wall 14. The vertically extending wall structure 24 is preferably spaced a sufficient horizontal distance from the drive-up window 20 in the wall 14 to allow passage of an automobile therebetween. Similarly, the horizontally extending roof structure 22 is preferably positioned a sufficient distance above the ground to allow passage of an automobile thereunder.

The apparatus 10 includes a plurality of downwardly directed nozzles 26 communicating with a fluid distribution system 28 housed within and supported by the roof structure 22. The fluid distribution system 28 is preferably constructed of lengths of conduit formed of metallic or synthetic resinous materials. The fluid distribution system 28 is arranged such that the downwardly extending nozzles 26 are disposed in a substantially rectangular array as shown in FIG. 1.

A fluid reservoir 30, preferably in the form of a closed vessel, is mounted near the fluid distribution system 28 and preferably rearwardly of the inner side 18 of the wall 14. An outlet conduit 32 extends through an outlet passage 34 in the closed vessel of the fluid reservoir 30. A fluid tight seal is provided between the outlet passage 34 and the outlet conduit 32. The lower end 36 of the outlet conduit 32 communicates with the fluid 37 contained within the reservoir 30. The upper end 38 of the outlet conduit 32 communicates with a pressure relief valve 40. A conduit 42 communicates between the pressure relief valve 40 and a one-way check valve 44. The check valve 44 communicates with the fluid distribution system 28 via conduit 46.

A source of pressurized fluid, preferably in the form of a conventional compressed gas tank 48 communicates with the inlet passage 50 in the fluid reservoir 30 via conduit 52. A valve 54 is interposed in the conduit 52 adjacent to the source of pressurized fluid 48. The valve 54 is preferably an electrically actuated, solenoid operated valve of conventional design. It will be understood that other types of valves such as mechanically or manually operated valves may be employed in place of an electrically actuated valve, however, an electrically actuated valve provides advantages in the area of remote control of the apparatus 10 as will be described in greater detail hereinafter.

A two-way valve 56 is interposed in the conduit 52 adjacent to the valve 54. The two-way valve 56 may suitably be a manually operated valve of conventional construction.

A one-way check valve 58 is interposed in the conduit 52 adjacent to the one-way valve 56, and a pressure relief valve 60 is interposed in the conduit 52 intermediate the one-way check valve 58 and the inlet passage 50 of the fluid reservoir 30.

It will be understood that the one-way check valve 44 provides fluid flow therethrough in one direction from the fluid reservoir 30 to the fluid distribution system 28 and the nozzles 26. Similarly, the one-way check valve 58 provides fluid flow in one direction therethrough from the source of pressurized fluid 48 to the fluid reservoir 30.

A conduit 62 communicates between the two-way valve 56 and the conduit 46. A one-way check valve 64 is interposed in the conduit 62 and provides fluid flow therethrough in one direction from the two-way valve 56 to the conduit 46.

Figure 2:
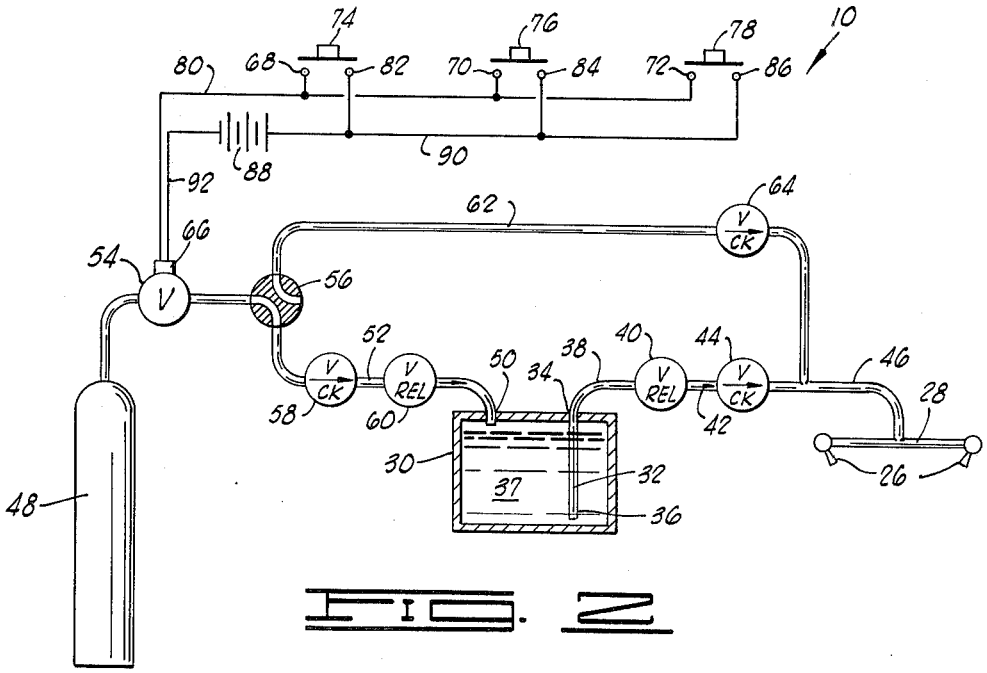
FIG. 2 is a schematic diagram illustrating the electrical circuitry and the fluid system of the present invention.

As shown in FIG. 2, the solenoid 66 of the valve 54 is connected to the contacts 68, 70 and 72 of the respective normally open, push-button switches 74, 76 and 78 by means of an electrical conduit 80. Switch contacts 82, 84 and 86 of switches 74, 76 and 78 are connected to one pole of a source of electrical potential 88 by means of an electrical conduit 90. The opposite pole of the source of electrical potential 88 is connected to the solenoid 66 by means of an electrical conduit 92.

The source of electrical potential 88 may be in the form of one or more rechargeable or non-rechargeable electrical cells or storage batteries. The source of electrical potential 88 may also be a rectified DC potential obtained by conventional rectifier means from an AC electrical source such as common 110 volt or 220 volt AC house power.

The apparatus 10 may be suitably installed as illustrated in FIG. 1 with the compressed gas tank 48 positioned inwardly of the inner side 18 of the wall 14 and preferably near the drive-up window 12. Similarly, the fluid reservoir 30 is also preferably mounted inwardly of the inner side 18 of the wall 14 but as near as possible to the fluid distribution system 28 to minimize the length of the conduits 32, 42 and 46 interconnecting the fluid reservoir 30 and the fluid distribution system 28.

The fluid distribution system 28 and the nozzles 26 connected thereto are preferably supported by and enclosed within the roof structure 22 in a manner such that the fluid distribution system 28 is completely screened from view with only the lower ends of the downwardly extending nozzles 26 being exposed. In a similar manner, the conduit 46 is also preferably enclosed within the roof structure 22.

The downwardly extending nozzles 26 are aligned such that fluid streams emanating from the nozzles 26 will impinge upon the front and rear windshields and the side windows of an automobile when positioned thereunder to transact business with the teller behind the drive-up window 12.

One normally open switch 74 is preferably located on or near the teller's counter 20 so that it may be conveniently operated by the teller manning the drive-up window 12. The remaining switches 76 and 78 may be located at various other points either inwardly of the wall 14 or at some other location so that they may be conveniently operated by persons other than the teller manning the drive-up window 12 in the event the teller is occupied with other matters.

The fluid 37 contained within the fluid reservoir 30 is preferably a liquid chemical agent, such as paint. This liquid chemical agent is preferably relatively viscous and adhesive and substantially opaque. The preferably high viscosity of the liquid chemical agent is intended to prevent the removal of the liquid chemical agent from the windshield of an automobile through the operation of the windshield wipers as will be explained in greater detail hereinafter. The liquid chemical agent may also include a radioactive component which will provide assistance in tracking and locating any vehicle or person having the liquid chemical agent adhered thereto by suitable means such as a Geiger counter or other device sensitive to the radiation of the radioactive component.

OPERATION

In order to operate the apparatus 10, the two-way valve 56 is placed in position to provide fluid communication between the valve 54 and the one-way check valve 58 as illustrated in FIGS. 1 and 2. The valve 54 is in its closed position as are the pressure relief valves 60 and 40. The fluid reservoir 30 is filled with the liquid chemical agent 37.

In the event of an attempted holdup of the teller manning the drive-up window 12 from an automobile positioned in front of the drive-up window 12, the teller may close the switch 74 to actuate the solenoid 66 and open the valve 54. When the valve 54 is open, the pressurized fluid or compressed gas in the source of pressurized fluid 48 is applied through the valves 54, 56 and 58 and the conduit 52 to the pressure relief valves 60. When the pressure applied to the pressure relief valve 60 exceeds a predetermined value, the pressure relief valve 60 opens applying fluid pressure through the inlet passage 50 into the fluid reservoir 30 thereby applying pressure to the liquid chemical agent 37 contained therein. When the pressure of the liquid chemical agent 37 applied through the outlet conduit 32 to the pressure relief valve 40 exceeds a predetermined opening pressure of the pressure relief valve 40, the pressure relief valve 40 opens permitting the liquid chemical agent to flow therethrough through conduit 42, one-way check valve 44, conduit 46, fluid distribution system 28 and the downwardly extending nozzles 26 thus spraying the liquid chemical agent 37 on the front and rear windshields and side windows of the holdup vehicle thereby immobilizing the vehicle and leaving the holdup man without means for escape.

After such use of the apparatus 10, the conduit 46, distribution system 28 and nozzles 26 may be purged of the liquid chemical agent 37 by actuating the two-way valve 56 to place the valve 54 and the conduit 62 in fluid communication thereby directing the compressed gas from the source of pressurized fluid 48 through the conduit 62 and one-way check valve 64 into the conduit 46, fluid distribution system 28 and out through the nozzles 26 to drive any residual liquid chemical agent therefrom.

If desired, a second fluid reservoir, substantially identical to the fluid reservoir 30, may be interposed in the conduit 62 intermediate the two-way valve 56 and the one-way check valve 64 containing a suitable liquid cleaning or flushing agent, such as water, to assist in purging the system after operation.

It will be understood that the apparatus 10 may be operated by personnel other than the teller manning the drive-up window 12 by closing one of the other switches 76 or 78 located at positions remote from the drive-up window 12.

The apparatus 10 provides means for periodically checking the system and purging the fluid distribution system 28 and nozzles 26 by placing the two-way valve 56 in the position communicating the valve 54 with the conduit 62. With the valve 56 in this condition, each of the switches 74, 76 and 78 may be actuated to check the operation of the system and the output of the nozzles 26 may also be checked to assure that none of the nozzles 26 has become plugged and inoperative.

It will be understood that various forms of fluid reservoirs may be substituted for the fluid reservoir 30 schematically illustrated in FIG. 2. One suitable form of fluid reservoir would be a self-contained sealed unit charged with a quantity of liquid chemical agent which could include the check valve 44 and 58 and the pressure relief valves 40 and 60 as an integral part thereof. Such a fluid reservoir could be readily interconnected between the two-way valve 56 and the conduit 46 thus facilitating the recharging of the apparatus 10 after use or the renewing of the supply of the liquid chemical agent 37 after a given period of time so as to assure proper operation of the apparatus 10.

It will also be understood that various forms of switches may be substituted for the push-button switches 74, 76 and 78 described above. Other suitable switches would be toggle switches, foot-operated switches, or other switches which would temporarily or permanently lock in a closed position at the time of actuation.

It should further be understood that the vertically extending wall structure 24 would preferably be completely closed so as to minimize the effect of the spray of liquid chemical agent on the surrounding area or adjacent automobiles when the apparatus 10 is operated.

It will be seen from the foregoing detailed description of the present invention that the drive-up teller window protection apparatus described herein provides novel means for protecting a manned drive-up teller window through the application of a liquid chemical agent to immobilize the holdup vehicle and prevent the escape of one who would attempt or otherwise successfully perpetrate a holdup on a manned drive-up teller's window.

Changes may be made in the combination and arrangement of parts or elements as heretofore set forth in the specification and shown in the drawings without departing from the spirit and the scope of the invention as defined in the following claims.

What is claimed is:

1. In a protective construction for use with a drive-up window in a first wall having inner and outer sides and having a teller's counter spaced inwardly from the inner side of the wall, the improvement comprising:

a second wall spaced from the outer side of the first wall a distance sufficient to allow passage of an automobile therebetween;

a roof structure extending between said first and second walls above the drive-up window and positioned a vertical distance above the ground sufficient to allow passage of an automobile thereunder;

a plurality of downwardly directed nozzles mounted in said roof structure in spaced relation, said nozzles being aligned such that fluid streams emanating therefrom impinge on the windshield and windows of an automobile positioned thereunder adjacent the drive-up window;

fluid distribution system means for communicating with said nozzle;

fluid reservoir means for communicating with said fluid distribution system means;

liquid chemical agent means disposed within said fluid reservoir means for passing through said fluid distribution system means and said nozzles and forming fluid streams emanating from said nozzles and impinging on the windshield and windows of an automobile to obscure vision therethrough and mark the automobile for identification;

means for applying pressure to said fluid reservoir means to pass said liquid chemical agent means from said reservoir means and through said fluid distribution system means and said nozzles; and control means for alternately permitting and preventing the application of pressure by said means for applying pressure in response to control signals applied thereto.

2. The apparatus as defined in claim 1 wherein said control means is characterized further to include an electrically actuated valve.

3. The apparatus as defined in claim 2 wherein said control means is characterized further to include an electrical circuit interconnecting a source of electrical potential and the electrically actuated valve, said electrical circuit including switch means intermediate a source of electrical potential and the electrically actuated valve for closing the circuit between the source of electrical potential and the electrically actuated valve to cause said electrically actuated valve to open and, alternately, for opening the circuit between the source of electrical potential and the electrically actuated valve to cause the electrically actuated valve to close.

4. The apparatus as defined in claim 3 wherein said electrical circuit includes at least one additional switch means intermediate the source of electrical potential and the electrically actuated valve for closing the circuit between the source of electrical potential and the electrically actuated valve to cause said electrically actuated valve to open and, alternately, for opening the circuit between the source of electrical potential and the electrically actuated valve to cause the electrically actuated valve to close, each said switch means being operable independently of the other switch means.

5. The apparatus as defined in claim 1 wherein said means for applying pressure to said fluid reservoir means is a closed pressure tank containing compressed gas.

6. The apparatus as defined in claim 1 wherein said fluid reservoir means is characterized further to include:

a closed vessel;

an inlet passage in said closed vessel communicating with a conduit from said means for applying pressure to said fluid reservoir means; and an outlet passage in said closed vessel having an outlet conduit extending therethrough with one end thereof communicating with said liquid chemical agent means in said vessel and with the opposite end thereof communicating with said fluid distribution system means.

7. The apparatus as defined in claim 6 characterized further to include:

a normally closed first pressure relief valve interposed in the conduit intermediate said means for applying pressure to said fluid reservoir means and said closed vessel; and a normally closed second pressure relief valve interposed in said outlet conduit intermediate said liquid chemical agent means and said fluid distribution system means.

8. The apparatus as defined in claim 1 characterized further to include:

a two-way valve interposed in the conduit intermediate said means for applying pressure to said fluid reservoir means and said fluid reservoir means;

a bypass conduit communicating between said two-way valve and said fluid distribution system means; and means for actuating said two-way valve to place said means for applying pressure in communication with said fluid distribution system means through said conduit and said fluid reservoir means and, alternately, through said bypass conduit thereby bypassing said fluid reservoir means.

9. The apparatus as defined in claim 1 wherein said liquid chemical agent means is paint.

10. The apparatus as defined in claim 1 wherein said liquid chemical agent means includes a radioactive component.

11. The apparatus as defined in claim 1 wherein said control means is characterized further to include:

an electrically controlled solenoid actuated valve; and an electrical circuit interconnecting a source of electrical potential and the solenoid of said solenoid actuated valve, said electrical circuit including switch means intermediate the source of electrical potential and the solenoid for closing the circuit between the source of electrical potential and the solenoid to cause said solenoid actuated valve to open and, alternately, for opening the circuit between the source of electrical potential and the solenoid to cause the solenoid actuated valve to close, said switch means being operable from a position inwardly from the first wall carrying the drive-up window.

12. The apparatus as defined in claim 11 wherein said source of electrical potential is a storage battery.

* * * * *